United States Patent [19]

Cole

[11] 4,455,795

[45] Jun. 26, 1984

[54] POST ANCHORING DEVICE

[76] Inventor: Robert F. Cole, 2315 Diamond St., Stanton, Del. 19804

[21] Appl. No.: 233,378

[22] Filed: Feb. 11, 1981

[51] Int. Cl.[3] ..... E02D 5/74; E02D 27/42

[52] U.S. Cl. ..... 52/155; 52/165; 52/298

[58] Field of Search ..... 52/155, 679, 165, 69.13, 52/297, 298, 243.1, 704; 248/146, 156, 530, 545, 548; 40/607

[56] References Cited

U.S. PATENT DOCUMENTS

| | | | |
|---|---|---|---|
| 213,932 | 4/1879 | Powell | 52/155 |
| 427,815 | 5/1890 | Wolf | 52/155 |
| 435,978 | 9/1890 | Ramer, Jr. et al. | 52/165 |
| 444,497 | 1/1891 | Lounsberry | 52/165 |
| 2,554,887 | 5/1951 | Tricarico . | |
| 2,647,593 | 8/1953 | Holman | 52/165 |
| 2,759,486 | 8/1956 | Pesaturo . | |
| 2,976,000 | 3/1961 | Gunderson . | |
| 3,342,444 | 9/1967 | Nelson . | |
| 3,441,239 | 3/1967 | Frost | 248/545 |
| 3,724,145 | 4/1973 | Daniel | 52/165 |
| 3,809,346 | 5/1974 | Jackson . | |
| 3,820,750 | 6/1974 | Deike . | |
| 3,843,079 | 10/1974 | Reisling . | |
| 4,004,383 | 1/1977 | Watanabe | 52/165 |
| 4,156,332 | 5/1979 | Thompson | 52/165 |
| 4,235,034 | 11/1980 | Black . | |
| 4,242,822 | 1/1981 | Black . | |
| 4,275,535 | 6/1981 | Stalzer | 52/155 |

FOREIGN PATENT DOCUMENTS

| | | |
|---|---|---|
| 374270 | 6/1932 | United Kingdom . |
| 581915 | 10/1946 | United Kingdom . |

*Primary Examiner*—Alfred C. Perham

*Attorney, Agent, or Firm*—Connolly and Hutz

[57] ABSTRACT

Post anchoring device comprises main body section having post receiving opening at upper end thereof. Body section has open lower end and side wall portions that surround post when inserted into upper opening thereof. Single fixed anchoring stake is permanently secured to outer surface of one of side wall portions of main body section. Stake has top end adjacent post receiving opening of main body section and ground engaging lower end downwardly spaced from open lower end of main body section. In use stake is driven into ground until lower edges of main body section are at ground level. Signpost or other post form is then inserted into upper opening of main body section.

4 Claims, 6 Drawing Figures

FIG 1
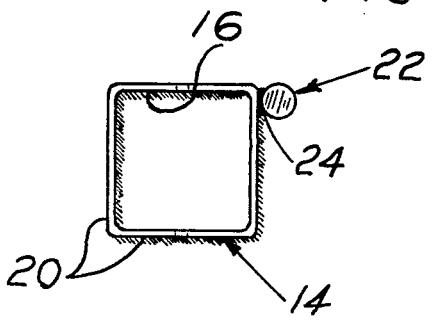
FIG 3
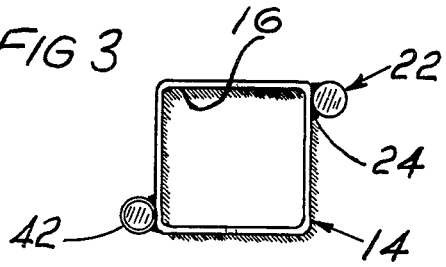
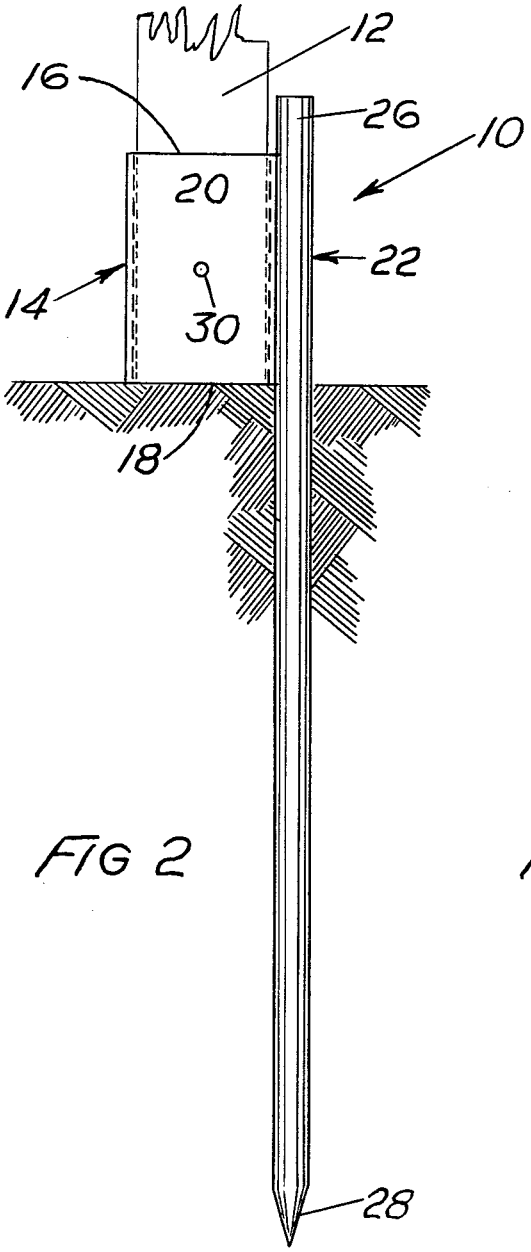
FIG 2
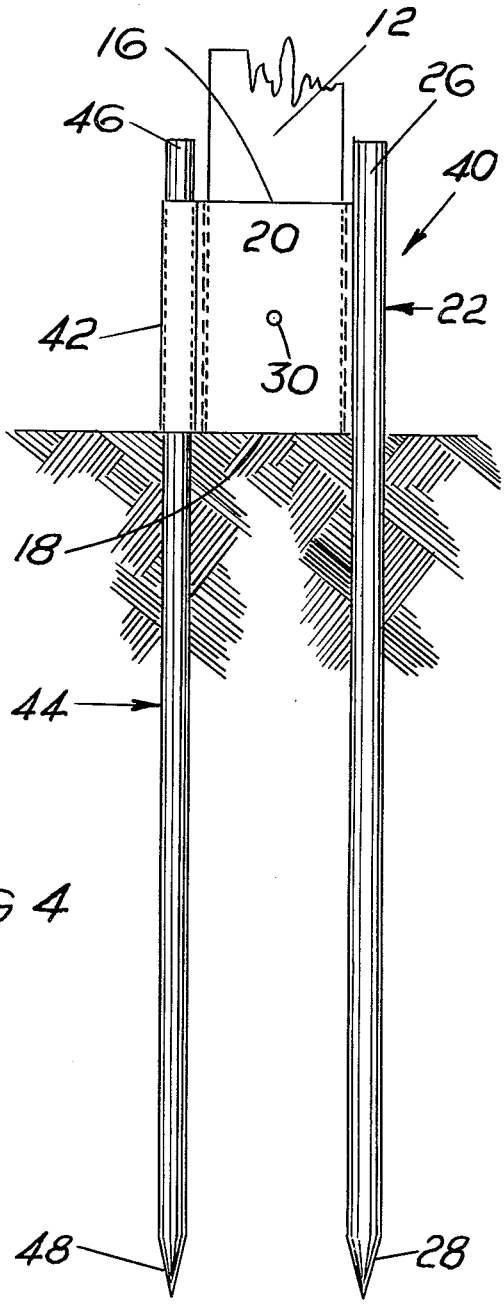
FIG 4

POST ANCHORING DEVICE

BACKGROUND OF THE INVENTION

The present invention relates to an anchoring device, and more particularly to a device for anchoring a signpost and the like.

Prior to the present invention, numerous methods and arrangements have been used for anchoring a signpost at a desired location. The most common method probably comprises simply digging a hole and inserting the post in the hole at a depth sufficient to anchor it to the ground. The disadvantages of this method involve the need for special tools, the problem of removal of excess dirt, the time and effort required, and the general messiness of the operation. Additionally, structural arrangements have been proposed for holding signposts and the like but these devices are either unduly complicated and difficult to use or lack sufficient holding strength. For example, U.S. Pat. Nos. 4,242,822 and 4,235,034 disclose removable signpost holding apparatus.

SUMMARY OF THE INVENTION

Accordingly, it is an object of the present invention to provide a post anchoring device which is simple to install, eacy to use and effective in anchoring a post to the ground.

In accordance with the present invention a post anchoring device comprises a main body section having a post receiving opening at the upper end thereof. The body section has an open lower end and side wall portions that surround a post when inserted into the upper opening thereof. A single fixed anchoring stake is permanently secured to the outer surface of one of the side wall portions of the main body section. This stake has a top end adjacent the post receiving opening of the main body section and a ground engaging lower end downwardly spaced from the open lower end of the main body section.

The post anchoring device may include an open ended tubular socket permanently secured to the outer surface of the side wall portions of the main body section opposite the fixed anchoring stake. A separate anchoring stake is slidably receivable within the tubular socket. Additionally, the main body section may include means for releasably securing a post thereto after insertion into the upper opening of the body section. Preferably, the side wall portions of the main body section define square upper and lower ends. The lower ends of the side wall portions may be angled relative to the horizontal so as to form ground penetrating edges that dig into the earth when the anchor is installed.

BRIEF DESCRIPTION OF THE DRAWING

Novel features and advantages of the present invention in addition to those mentioned above will become apparent to those skilled in the art from a reading of the following detailed description in conjunction with the accompanying drawing wherein:

FIG. 1 is a top plan view of a post anchoring device according to the present invention;

FIG. 2 is a side elevational view of the post anchoring device shown in FIG. 1;

FIG. 3 is a stop plan view of another post anchoring device according to the present invention;

FIG. 4 is a side elevational view of the post anchoring device shown in FIG. 3;

DETAILED DESCRIPTION OF THE INVENTION

Figure 5:
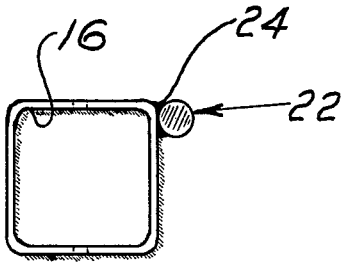
FIG. 5 is a top plan view of still another post anchoring device according to the present invention.

Referring in more particularity to the drawing, FIGS. 1 and 2 illustrate a post anchoring device 10 for holding a post 12 in an upright position. The post may be used to support an appropriate sign and the device 10 functions to secure that post to the ground. The post anchoring device 10 comprises a main body section 14 having a post receiving opening 16 at the upper end thereof. The body section 14 has an open lower end 18 and side wall portions 20 that surround the post 12 when it is inserted into the upper opening 16. A single fixed anchoring stake 22 is permanently secured to the outer surface of one of the side wall portions at 24. The stake 22 has a top end 26 adjacent the post receiving opening 16 of the main body section 14 and a ground engaging lower end 28 downwardly spaced from the open lower end 18 of the body section.

As shown best in FIG. 2, the main body section 14 includes an opening 30 in the central portion of one of the side walls, and one or more similar openings may be provided in the remaining side walls of the body section. Nails or other similar fasteners (not shown) may then be driven through the holes into the post 12 after it is inserted into the upper opening 16 of the body section.

In use, the top end 26 of the anchoring stake 22 is driven into the ground with a suitable tool such as a hammer or a sledge. The stake is driven until the lower end of the body section 14 engages the ground. The post 12 is then inserted into the upper open end 16 of the body section until it rests upon the surface of the ground. The body section is configured so as to closely conform to the shape of the post 12 to thereby hold it in an upright position. Fasteners may be inserted into the openings 30 to fix the post to the anchoring device 10, as explained above, if desired.

While the anchoring device 10 is shown in its fully driven position, it is also possible to anchor a post when the main body section 14 is still a distance away from ground level. This may occur when the stake 22 is sufficiently embedded in the ground but strikes an object such as a rock, root or boulder. However, when this occurs, the post 12 is simply inserted into the upper open end 16, through the main body section 14, and out the lower open end 18 thereof until the post engages the ground. As shown best in FIG. 1, the side wall portions 20 of the main body section 14 define square upper and lower open ends 16,18 respectively. However, when the cross-sectional configuration of the post 12 is other than square, these openings and the side wall portions are suitably configured so as to conform to the cross-section of the post.

Turning now to FIGS. 3 and 4, another post anchoring device 40 is shown having many similarities to the anchoring device 10 of FIGS. 1 and 2. For simplicity of explanation, like parts of the device 40 are identified with like reference characters used to describe the device 10. The post anchoring device 40 differs from the device 10 in that additional ground securing structure is provided on the device 40. Specifically, a tubular socket 42 is permanently secured to the outer surface of the side wall portions 14 opposite the fixed anchoring stake 22. As shown best in FIG. 3, the tubular socket 42 is located diagonally opposite the fixed stake 22 but other locations may be used so long as the tubular socket is sufficiently spaced from the stake 12. A separate anchoring stake 44 having a top end 46 and a ground engaging end 48 is slidably receivable within the tubular socket 42.

In use, the post anchoring device 40 is initially secured to the ground in the same manner as device 10, that is by hammering the upper end 26 of stake 22 until the lower end of the body section 14 engages the ground. Next, the separate anchoring stake 44 is slidably inserted into the tubular socket 42 until the lower end 48 hits the ground. The upper end 46 may then be struck with a hammer or a sledge until the stake 44 is sufficiently fixed to the ground thereby anchoring the device 40 to the ground. The post 12 is then inserted into the upper open end 16 of the body section until it rests upon the surface of the ground. Here again the body section is configured so as to closely conform to the shape of the post 12 to thereby hold it in an upright position. Fasteners (not shown) may be inserted into the openings 30 to fix the post to the anchoring device 40, if desired.

Figure 6:
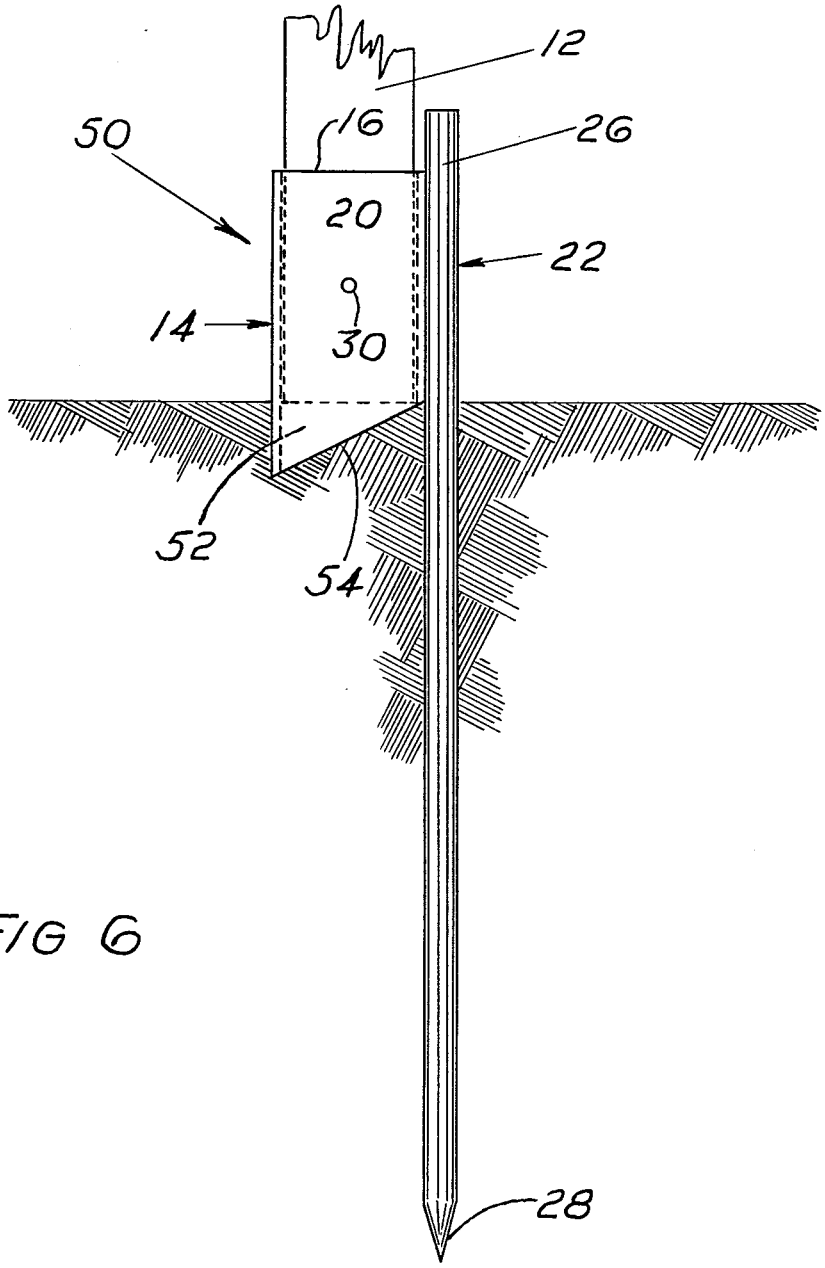
FIG. 6 is a side elevational view of the post anchoring device shown in FIG. 5.

FIGS. 5 and 6 illustrate another post anchoring device 50 according to the present invention. Device 50 is similar in many respects to the post anchoring devices 10 and 40 shown in FIGS. 1–4, and similar reference characters are utilized to identify similar parts. As best shown in FIG. 6, the lower end 52 of the main body section 14 is angled relative to the horizontal so as to form ground penetrating edges 54 on the body section. By embedding the lower end 52 in the ground, greater anchoring stability is achieved. In use, the post anchoring device 40 is driven into the ground in the same manner as described above in conjunction with the anchoring device 10, the only difference being that continued impaction upon the upper top end 26 of the stake 22 causes the lower end 52 of body section 14 to enter the ground. After such installation the post 12 is inserted into the body section and secured thereto, if desired, in the same manner as described above.

What is claimed:

1. A post anchoring device comprising a main body section having a post receiving opening at the upper end thereof, an open lower ground engaging end, and side wall portions that completely surround a post when inserted into the upper opening thereof, a single fixed anchoring stake permanently secured to the outer surface of one of the side wall portions of the main body section having a top end adjacent the post receiving opening of the main body section and a ground penetrating lower end downwardly spaced from the open lower ground engaging end of the main body section, an open ended tubular socket permanently secured to the outer surface of the side wall portions of the main body section opposite the fixed anchoring stake, and a separate anchoring stake slidably receivable within the tubular socket.

2. A post anchoring device as in claim 1 including means on the main body section for releasably securing a post thereto.

3. A post anchoring device as in claim 1 wherein the side wall portions of the main body section define square upper and lower open ends.

4. A post anchoring device as in claim 1 wherein the top end of the single fixed anchoring stake is slightly above the post receiving opening of the main body section.

* * * * *